US006234829B1

(12) United States Patent
Thomsen

(10) Patent No.: US 6,234,829 B1
(45) Date of Patent: May 22, 2001

(54) METHOD AND DEVICE FOR IDENTIFYING CARD SLOTS THAT ARE REQUIRED TO BE POPULATED CONCURRENTLY IN A COMPUTER SYSTEM

(75) Inventor: Peter Matthew Thomsen, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/276,230

(22) Filed: Mar. 25, 1999

(51) Int. Cl.[7] ..... H01R 3/00

(52) U.S. Cl. ..... 439/488; 439/491

(58) Field of Search ..... 439/488, 315, 439/489, 491; 340/656

(56) References Cited

U.S. PATENT DOCUMENTS

| | | | | |
|---|---|---|---|---|
| 5,634,803 | | 6/1997 | Cheng et al. | 439/157 |
| 5,821,510 | * | 10/1998 | Cohen et al. | 235/375 |
| 5,862,774 | * | 1/1999 | Moss | 116/200 |

* cited by examiner

*Primary Examiner*—Lincoln Donovan
*Assistant Examiner*—Chandrika Prasad
(74) *Attorney, Agent, or Firm*—Bracewell & Patterson, LLP

(57) ABSTRACT

A method of installing computer components, such as dual in-line memory modules (DIMMs), by associating a subset of component connectors with a logical connector group that is to be concurrently populated, and color-coding the socket connectors to identify the subset of connectors. The DIMMs are attached to the socket connectors in the identified subset of socket connectors. The color-coding may be accomplished using color-coded retention tabs attached to the connectors, or by coloring the whole body of each socket connector.

20 Claims, 2 Drawing Sheets

METHOD AND DEVICE FOR IDENTIFYING CARD SLOTS THAT ARE REQUIRED TO BE POPULATED CONCURRENTLY IN A COMPUTER SYSTEM

BACKGROUND OF THE INVENTION

1. Field of the Invention

The present invention generally relates to computer systems, and more specifically to a method and device for installing computer components, particularly printed circuit boards or cards, such as dual in-line memory modules (DIMMs), which are mounted in slots or sockets of the computer system.

2. Description of Related Art

The basic structure of a conventional computer system 10 is shown in FIG. 1. Computer system 10 has at least one central processing unit (CPU) or processor 12 which is connected to several peripheral devices, including input/output devices 14 (such as a display monitor, keyboard, and graphical pointing device) for the user interface, a permanent memory device 16 (such as a hard disk) for storing the computer's operating system and user programs, and a temporary memory device 18 (such as random access memory or RAM) that is used by processor 12 to carry out program instructions. Processor 12 communicates with the peripheral devices by various means, including a bus 20 or a direct channel 22 (more than one bus may be provided using a bus bridge).

Computer system 10 may have many additional components which are not shown, such as serial and parallel ports for connection to, e.g., modems or printers. Those skilled in the art will further appreciate that there are other components that might be used in conjunction with those shown in the block diagram of FIG. 1; for example, a display adapter connected to processor 12 might be used to control a video display monitor, and a memory controller may be used as an interface between temporary memory device 18 and processor 12. Computer system 10 also includes firmware 24 whose primary purpose is to seek out and load an operating system from one of the peripherals (usually permanent memory device 16) whenever the computer is first turned on.

Conventional computer systems often allow the user to add various components after delivery from the factory. For peripheral devices, this can be accomplished using an "expansion" bus, such as the Industry Standard Architecture (ISA) bus or the Peripheral Component Interconnect (PCI) bus. Another component that is commonly added by the user is main memory which supplements temporary memory device 18. Additional memory, which supplements temporary memory device 18. This memory is often made up of a plurality of memory modules that can be added or removed as desired. The memory modules usually have memory chips in dual in-line packages, mounted on a single circuit board or card, and so are referred to as dual in-line memory modules (DIMMs). DIMMs can be added to upgrade a system's memory, or to replace older modules that have become defective.

Each DIMM has an edge with a plurality of contacts or pins (e.g., 72 pins), adapted to mate with a card edge connector (socket or slot). A typical DIMM 30 and socket 32 connector are shown in FIG. 2. DIMM 30 is generally comprised of a flat, rectangular substrate or card 34, supporting a plurality of memory chips 36. The body of socket 32 has a slot 38 formed therein for receiving the contact edge of DIMM 30. DIMM 30 may be conveniently retained in slot 38 using retention tabs 40 having clips which engage small notches 42 formed in the side edges of card 34. In this manner, the DIMM is latched firmly within connector 32 without possibility of accidental removal by inadvertent contact with the card, or external vibrations and impacts.

Tabs 40 are also used for ejecting card 34 from slot 38. Tabs 40 are pivotally mounted and biased to the closed, locking position, but when they are forcibly moved (with a finger or tool) to the open, unlocked position, a lower boss member (not visible in FIG. 2) attached to each tab pushes the contact edge of card 34, ejecting it out of slot 38.

DIMMs are available in different sizes, and not only with respect to physical size, but also with respect to the amount of memory that they provide. For example, DIMMs used with personal computers (PCs) often come in sizes of 16 megabytes, 32 megabytes, 64 megabytes, 128 megabytes, 256 megabytes, etc.

Within a given computer, the slot connectors for the memory modules are often arranged in two or more banks. This arrangement of memory banks is usually both physical and logical, that is, the layout of the slot connectors on the memory card or computer's primary circuit board (the "motherboard") has connectors grouped by banks, and these same groupings correspond to logical banks that are used by the hardware specific to that computer system, i.e., the memory controller. Oftentimes, it is necessary to place DIMMs in particular slots, due to the architecture of the hardware. For example, if DIMMs of different sizes (available RAM) are mixed in a single computer (e.g., several 64 megabyte DIMMs and several 128 megabyte DIMMs), it is necessary to place the particular types of DIMMs in certain respective slots. If the modules are not placed correctly, various problems may occur, such as the firmware simply not recognizing the full amount of memory that is available, which significantly impairs overall performance.

In the prior art, it is often difficult to identify which particular connector on a motherboard is to receive a new component, such as a DIMM. DIMM sockets are not clearly identified by logical group, and this lack of suitable identification presents a problem when DIMM's must be concurrently populated for the memory card to work. DIMM sockets can be identified using reference designations or silkscreen labelling on the memory card, but most often a service manual is required to determine where to plug particular DIMM's. It would, therefore, be desirable to devise a method which would eliminate the need for silkscreen labelling or other costly processes, and also remove the requirement for the customer to refer to the service manual in order to add DIMM's in the correct positions.

SUMMARY OF THE INVENTION

It is therefore one object of the present invention to provide an improved method of installing computer components.

It is another object of the present invention to provide such a method that is usable with dual in-line memory modules (DIMMs).

It is yet another object of the present invention to provide a method of installing DIMMs by logical group, to ensure that DIMM's that must be concurrently populated are properly placed for the memory card to work, such as in DIMM pairs, quads or octets.

The foregoing objects are achieved in a method of installing a plurality of components of a computer system, generally comprising the steps of mounting a plurality of socket connectors to a substrate (and electrically connecting contacts of the connectors to respective leads formed on the substrate), associating a subset of the connectors with a logical connector group that is to be concurrently populated, color-coding the socket connectors to identify the subset of connectors, and attaching a plurality of computer components to two or more of the socket connectors in the subset of socket connectors. The color-coding may be accomplished using color-coded retention tabs attached to the connectors, or the whole body of the socket can be colored. The invention can be implemented with a memory card that receives a plurality of DIMMs, wherein the memory card is further connected to a motherboard of the computer system.

In further detail, the subset of connectors is a first subset, and the logical connector group is a first logical connector group, and the method further comprises the step of associating additional subsets of connectors with additional logical connector groups such that each connector mounted on the substrate is included in one and only one subset. For example, the card may have 32 socket connectors, with a total of eight subsets of the connectors. In this manner, the present invention eliminates the need for cryptic connector labelling or resort to a service manual in order to add DIMMs.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein:

DESCRIPTION OF AN ILLUSTRATIVE EMBODIMENT

Figure 1:
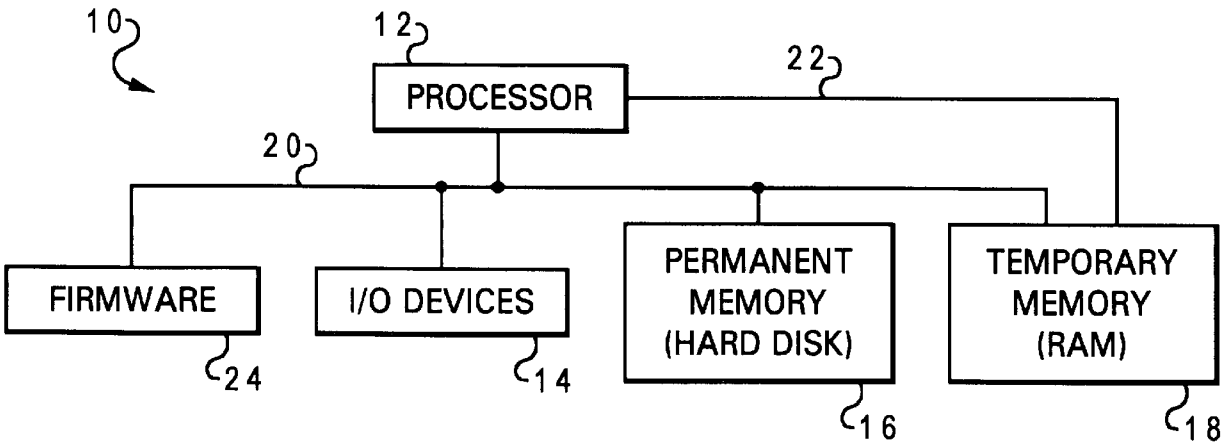
Fig. 1 Prior Art
FIG. 1 is a block diagram of a conventional computer system.
Figure 2:
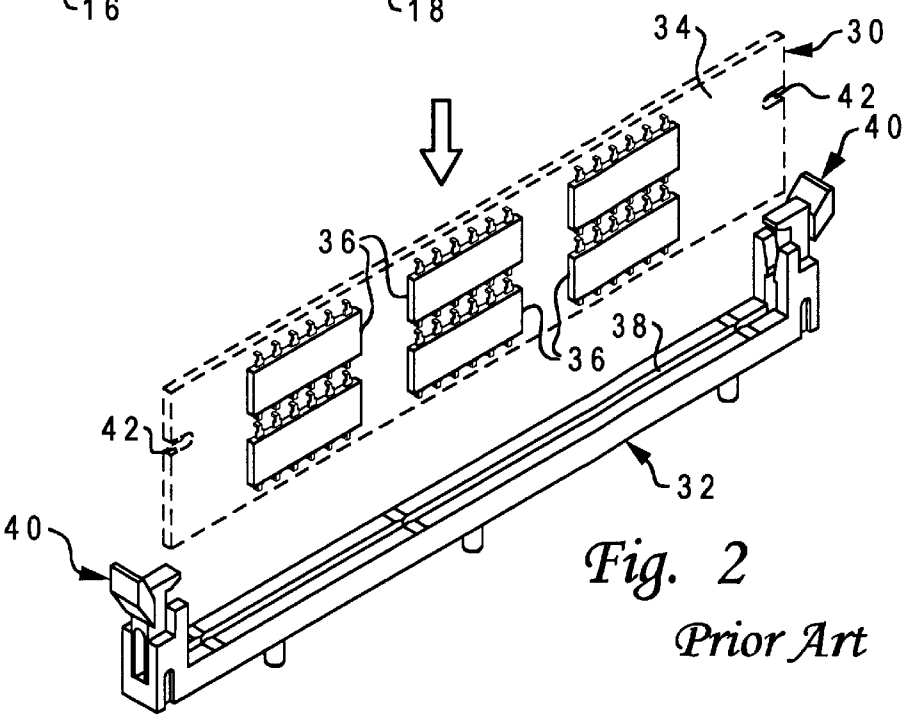
Fig. 2 Prior Art
FIG. 2 is a perspective view of a conventional socket connector for a dual in-line memory module (DIMM), used in computer systems to provide random access memory (RAM), with a conventional DIMM shown with dashed lines.
Figure 3:
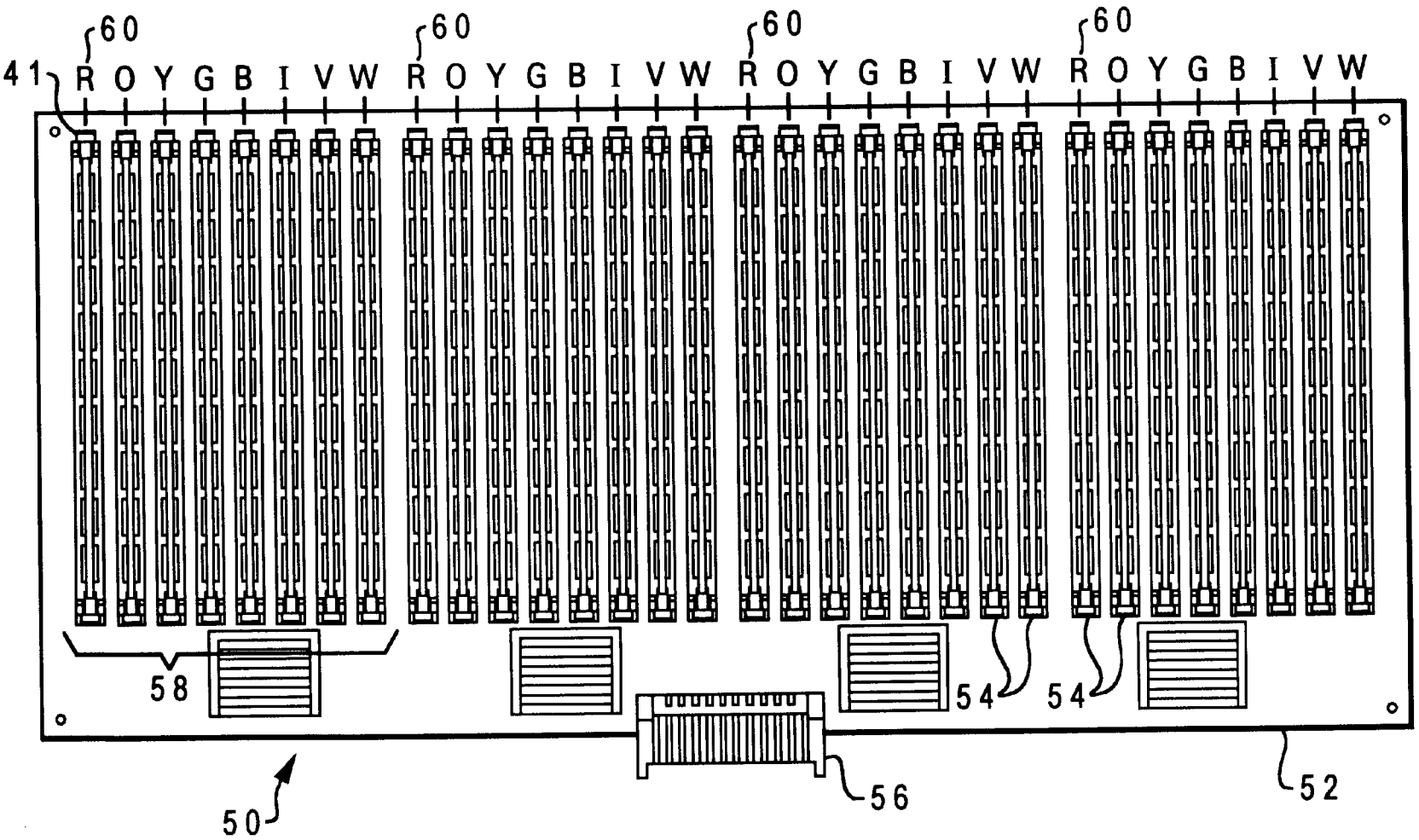
FIG. 3 is top plan view of a socket connector layout having a plurality of DIMM socket connectors, constructed in accordance with the present invention.

With reference now to FIG. 3, there is depicted one embodiment 50 of a memory card constructed in accordance with the present invention, which is adapted to provide system memory (RAM) for a computer system. Memory card 50 includes a substrate or board 52, and a plurality of connectors 54 mounted to board 52, and designed to receive respective dual in-line memory modules (DIMMs). The DIMMs may be of various constructions, including the conventional construction shown in FIG. 2. The memory provided by the DIMMs may be any one of a number of different types of RAM, for example, static random access memory (SRAM), dynamic random access memory (DRAM), or synchronous dynamic random access memory (SDRAM).

Socket connectors 54, in addition to being physically affixed to board 52, have electrical contacts which are also electrically connected to leads formed on the surface of board 52. Thus, connectors 54 are used to interconnect the pins of the DIMMs to the computer's motherboard using another set of contacts formed on the edge of a connector card 56 mounted to board 52. While the depicted embodiment shows a memory card, it is understood that the present invention could also be implemented using socket connectors which are attached directly to a motherboard or other circuit board, rather than to a memory card per se.

The present invention solves the problem of easily identifying which DIMM sockets to use when more than one DIMM is required to be populated. A color-coding technique is used to clearly identify any subsets or groups that must be concurrently populated. The invention consists of replacing the socket ejector tabs (i.e., the retention tabs 40 & FIG. 2) with different colored or colored-coded ejector tabs 41 (or coloring the whole connector body). Then, the different colored DIMM sockets are populated on the memory card in the correct positions.

The concept is illustrated in FIG. 3 using capital letters to denote the colors of the different colored ejector tabs (color-coded 41). This example shows 32 DIMM connectors divided in four (4) groups 58 with a requirement for the DIMMs to be populated in quads. Therefore, this example shows eight different colored DIMM sockets, red (R), orange (0), yellow (Y), green (G), blue (B), indigo (I), violet (V) and white (W). In this example, all the red DIMM sockets, which represents a subset 60 associated with a logical connector group, would be populated first, then the orange sockets, etc. Thus, the present invention eliminates the need for silkscreen labelling and other confusing conventional methods for identifying the proper slots, and likewise removes the requirement for a customer to refer to a service manual in order to add DIMMs. Moreover, the color-coding can be used to identify special subsets (logical groups) 60 that may be required for a particular type of DIMM. The memory cards may need to be populated in pairs, quads, etc., and the present invention can be applied to such configurations as well.

The dimensions of the various components of memory card may vary according to the application.

Although the invention has been described with reference to specific embodiments, this description is not meant to be construed in a limiting sense. Various modifications of the disclosed embodiments, as well as alternative embodiments of the invention, will become apparent to persons skilled in the art upon reference to the description of the invention. For example, while the invention has been described with reference to a memory card for receiving a plurality of DIMMs, it could also be implemented with slot connectors for other computer components. It is therefore contemplated that such modifications can be made without departing from the spirit or scope of the present invention as defined in the appended claims.

What is claimed is:

1. A method of identifying socket connectors to be populated by memory cards in a computer system, comprising the steps of:

providing a plurality of color-coded socket connectors mounted on a substrate, wherein a subset of the color-coded socket connectors is associated with a logical connector group that must be concurrently populated and has a unique color from among a plurality of colors utilized with said color-coded socket connectors, wherein said unique color indicates which ones of said memory cards may be connected to said subset of color-coded socket connectors; and in response to a recognition of said unique color, concurrently installing selected ones of said memory cards to two or more of the socket connectors in the particular subset of socket connectors.

2. The method of claim 1, wherein said providing step includes the step of attaching a plurality of color-coded ejector tabs to the socket connectors.

3. The method of claim 1, wherein said providing step includes the step of coloring a body of each socket connector.

4. The method of claim 1, wherein the substrate is a memory card, and further comprising the step of connecting the memory card to the computer system.

5. The method of claim 1, wherein the subset of socket connectors is a first subset and the logical connector group is a first logical connector group, and further comprising the step of associating each additional subsets of socket connectors with additional logical connector groups such that each socket connector mounted on the substrate is included in one and only one subset associated with a different unique color.

6. The method of claim 5, wherein the substrate has 32 socket connectors, and said associating steps define a total of eight subsets of four socket connectors.

7. The method of claim 5, wherein the memory cards are a first type from among a plurality of types of memory cards, and comprising the further step of attaching a plurality of memory cards of a second type to two or more of the socket connectors in one of the additional subsets of socket connectors.

8. A method of populating a plurality of slots of a computer memory block, comprising the steps of:

mounting a plurality of socket connectors to a substrate, wherein the socket connectors are adapted to receive memory modules;

color-coding the plurality of socket connectors to uniquely identify each of a plurality of subsets of connectors associated with a respective plurality of logical connector groups such that each connector mounted on the substrate is included in one and only one subset, wherein a color of each of said plurality of subsets indicate respective memory modules that may properly be connected to each of said subsets of connectors.

9. The method of claim 8, wherein said color-coding step includes the step of attaching a plurality of color-coded ejector tabs to the connectors.

10. The method of claim 8, wherein said color-coding step includes the step of coloring a body of each socket connector.

11. The method of claim 8, wherein the memory block has 32 socket connectors, and said color-coding step defines a total of eight subsets of four connectors.

12. A memory block for a computer system, comprising:

a substrate; and a plurality of socket connectors mounted to said substrate, wherein said socket connectors are color-coded to uniquely identify a plurality of subsets of the connectors which are respectively associated with a plurality of logical connector groups such that each connector mounted on said substrate is included in one and only one subset.

13. The memory block of claim 12, further comprising a plurality of memory modules respectively attached to said plurality of socket connectors, wherein said memory modules are of different types, and memory modules of a given type are attached to respective connectors in only an associated one of the subsets.

14. The memory block of claim 12, further comprising a card connector mounted to said substrate and adapted to interconnect said memory card with other components of the computer system.

15. The memory block of claim 12, wherein said socket connectors are arranged in groups on said substrate, and each group contains one and only one connector from each of the subsets of connectors.

16. The memory block of claim 15, wherein:

said socket connectors are arranged in four groups;

each of said groups contain eight connectors; and said connectors are divided into eight subsets, with one connector from each group being in a given subset.

17. A computer system using the memory block of claim 12, and further comprising firmware which defines said plurality of logical connector groups.

18. The method of claim 1, further comprising the step of attaching a plurality of memory cards to two or more of the socket connectors in the subset of socket connectors.

19. The method of claim 8, further comprising the step of attaching a plurality of memory modules to the socket connectors, wherein the memory modules are of different types, and memory modules of a given type are attached to respective connectors in only a given one of the subsets.

20. A method of manufacturing a memory block for a computer system, comprising the steps of:

providing a substrate; and mounting a plurality of socket connectors on said substrate, wherein said socket connectors are color-coded to identify logical connector groups that contain at least two socket connectors of a same color.

* * * * *